313-414
11/25/86 OR SR 4,625,146

United States Patent [19]

Van Gorkum

[11] Patent Number: 4,625,146

[45] Date of Patent: Nov. 25, 1986

[54] CATHODE RAY TUBE

[75] Inventor: Aart A. Van Gorkum, Eindhoven, Netherlands

[73] Assignee: U.S. Philips Corporation, New York, N.Y.

[21] Appl. No.: 609,620

[22] Filed: May 14, 1984

[30] Foreign Application Priority Data

Mar. 16, 1984 [NL] Netherlands ..... 8400841

[51] Int. Cl.[4] ..... H01J 29/50

[52] U.S. Cl. ..... 313/414; 313/409

[58] Field of Search ..... 313/412, 413, 414, 449, 313/460, 409

[56] References Cited

U.S. PATENT DOCUMENTS

| | | | |
|---|---|---|---|
| 2,220,839 | 11/1940 | Hahn | 313/449 |
| 3,735,178 | 5/1973 | Peper | 313/414 |
| 4,330,708 | 5/1982 | Meisburger | 313/460 |
| 4,370,592 | 1/1983 | Hughes et al. | 313/460 |
| 4,371,808 | 2/1983 | Urano et al. | 313/460 |

*Primary Examiner*—David K. Moore
*Attorney, Agent, or Firm*—Robert J. Kraus

[57] ABSTRACT

A cathode ray tube comprising in an evacuated envelope (1) an electron gun system (5,104) for generating at least one electron beam (6,7,8,105) which is focused on a target (10,108) by means of at least one accelerating electron lens (22,23,50,51). The lens viewed in the direction of propagation of the electron beam, comprises a first (22,50) and a second (23,51) electrode separated by a lens gap (30,53). In the second electrode is an electrically conductive foil or gauze (31,52) intersects the beam at a distance from the lens gap. When the foil or gauze is flat and is provided at such a location that $0.25 < l/R < 2.0$, where l is the distance from the foil or gauze to the lens gap and R is the radius of the part of the second electrode in which or against which the foil or gauze is provided. The spherical aberration in the electron beam is drastically reduced. Such a flat gauze moreover is easy to manufacture and assemble in an electron gun.

8 Claims, 12 Drawing Figures

CATHODE RAY TUBE

BACKGROUND OF THE INVENTION

The invention relates to a cathode ray tube comprising in an evacuated envelope an electron gun system for generating at least one electron beam which is focused on a target by means of at least one accelerating electron lens. Viewed in the direction of propagation of the electron beam, the lens comprises a first and a second electrode separated by a lens gap. In the second electrode an electrically conductive foil or gauze which intersects the beam is provided at a distance from the lens gap. Such cathode ray tubes are used, for example, as black-and-white or colour display tubes for television, as a television camera tube, as a projection television display tube, as an oscilloscope tube or as a tube for displaying digits or symbols. This latter type of tube is also termed a DGD tube (DGD=Data Graphic Display).

Such a cathode ray tube is known, for example, from German Patent Application No. 3,305,415 (corresponding to allowed U.S. patent application Ser. No. 458,231 filed Jan. 1, 1983) which is laid open to public inspection and which may be considered to be incorporated herein by reference. The above-mentioned Application discloses that spherical aberration can be drastically reduced by providing a curved, electrically conductive foil or gauze in the second electrode—viewed in the direction of propagation of the electron beam—of an accelerating lens of an electron gun. According to the invention described in the Patent Application the curvature of the foil or gauze must initially decrease with an increasing distance to the axis of the electron lens. The curvature preferably occurs according to a zero order Bessel function. The spherical aberration can even be made negative by providing a cylindrical collar which extends from the foil or gauze in the direction of the first electrode up to the lens gap.

In the above-described types of tube the dimensions of the spot are very important. In fact these determine the definition of the displayed or recorded television picture. There are three contributing factors which determines the spot dimensions, namely: (1) the differences in thermal emission velocities and angles of the electrons emitted from the emissive surface of the cathode, (2) the space charge of the beam, and (3) the spherical aberration of the electron lenses used. Regarding the latter factor, is that electron lenses do not focus the electron beam ideally. In general, those electrons forming the electron beam which enter an electron lens farther away from the optical axis of the lens are deflected more strongly by the lens than electrons which enter the lens closer to the axis. This is termed positive spherical aberration. The spot dimensions increase by the third power of beam parameters such as the angular aperture or the diameter of the incident electron beam. Spherical aberration is therefore sometimes termed a third order error. It was demonstrated long ago (W. Glaser, Grundlagen der Elektronenoptik, Springer Verlag, Wien 1952) that in the case of rotationally symmetrical electron lenses in which the potential beyond the optical axis is fixed by, for example, metal cylinders, a positive spherical aberration always occurs. By using curved foils, such as those following a zero order Bessel function, the spherical aberration is drastically reduced or is even made negative to compensate for the positive spherical aberration of a preceding or succeeding lens to thus reduce the spot dimensions.

SUMMARY OF THE INVENTION

It is not easy to manufacture such foils or gauzes curved according to zero order Bessel functions. It is therefore an object of the invention to provide a simpler and less expensive alternative for the known lenses having curved foils.

According to the invention a cathode ray tube of the type mentioned in the opening paragraph is characterized in that the foil or gauze is flat and is provided at such a location that $0.25<l/R<2.0$, where l is the distance from the foil or gauze to the lens gap and R is the radius of the part of the second electrode in which or near which the foil or gauze is provided. By providing the foil at such a distance from the lens gap in the second electrode, the field strength on the foil becomes more constant. As a result of this the spherical aberration of the lens becomes small and can even be made negative locally when in that area the field strength decreases with increasing distance to the axis.

Electron guns are also known in which two accelerating lenses are used for focusing the electron beam. In that case the invention may be used in one of the accelerating lenses or in both.

The use of foils and gauzes in electron lenses is not new and is described, for example, in Philips Research Reports 18, 465–605 (1963). When foils and gauzes were used, applications were considered in particular in which a very strong lens is desired with a comparatively small potential ratio of the lens. The potential ratio is the ratio between the potentials of the lens electrodes. In an accelerating lens the lens action takes place by a converging lens action in the low potential part of the lens and a smaller diverging action in the high potential part of the lens so that the resulting lens behaviour is converging. Hence the lens is composed of a positive and a negative lens. By providing a flat or spherically curved gauze or foil on the edge of the second electrode which faces the first electrode, the negative lens is removed and a purely positive lens is formed which hence has a much stronger lens action. However, the lens still has spherical aberration. A flat gauze or foil on the edge of an accelerating electron lens only gives a small reduction of the spherical aberration. By providing, according to the invention, a flat foil or gauze at a given distance from the lens gap, a strength variation of the lens takes place, the strength being increased more in the centre (around the axis) than at the edge. As a result of this a lens is obtained in a simple manner which has substantially the same strength for all paths of the electron beam. This is not the case for the known gauze lenses which have a flat gauze or foil connected to the edge of the second electrode, hence against the lens gap. By a suitable choice of the location of the flat gauze or foil according to the invention the spherical aberration can be drastically reduced or even made negative.

In contrast with a foil, a gauze has an extra factor affecting the dimension of the spot. This is a result of the apertures in the gauze which each act as a negative diaphragm lens. As described in Philips Research Reports 18, 465–605 (1963), this negative lens action is proportional to the pitch of the gauze. However, the pitch may be chosen so that the contribution is much smaller than the other contributions to the spot enlargement. The remaining contribution of the spherical aberration of the main lens can be made smaller than the contribution of the pitch of the gauze by a correct choice of the shape of the gauze.

By using the invention it is even possible to make an accelerating electron lens having a negative spherical aberration. This effect can also be obtained by making the distance (d) between the two electrodes of the accelerating lens larger. This negative spherical aberration may serve to compensate for a positive spherical aberration of another preceding or succeeding lens in the electron gun.

Since it is possible to reduce the spherical aberration in a cathode ray tube according to the invention, it is no longer necessary to use an electron lens having a lens diameter which is much larger than the beam diameter. As a result of this it is possible to make electron guns having lens electrodes of a comparatively small diameter as a result of which the neck of the cathode ray tube in which the electron gun is assembled may have a comparatively small diameter. Since as a result of this the deflection coils are situated nearer to the electron beams a smaller deflection energy will suffice. Suitable materials for the manufacture of such foils and gauzes are, for example, nickel, molybdenum and tungsten. A nickel gauze can very readily be electro-formed by electrolytic deposition. It is possible to make woven gauzes of molybdenum and tungsten having a transmission of 80%.

Because the accelerating electron lenses for cathode ray tubes according to the invention have substantially no spherical aberration, the electron guns can be constructed to be simpler and, for example, may consist of a cathode, a control grid and the accelerating electron lens.

Cathode ray tubes according to the invention are particularly suitable as projection television display tubes in which usually only one electron beam is generated.

Cathode ray tubes according to the invention are also suitable for displaying symbols and figures (DGD tubes).

One embodiment of a cathode ray tube in accordance with the invention which is simple to manufacture is a colour display tube having an electron gun system comprising three electron guns situated with their axes in one plane. At least the second electrode is cup-shaped and is common to all electron guns. The second electrode comprises collars extending from the lens gap and from the edge of the apertures in the bottom of the cup-shaped electrode, the foil or gauze being provided on or near the end of at least one of the collars.

Another embodiment of a colour display tube in accordance with the invention, which is even simpler to manufacture and assemble, is characterized in that a foil or gauze which is common to all electron beams is provided on or near the end of all collars.

Still another very suitable embodiment of a colour display tube in accordance with the invention is characterized in that the foil or gauze is connected against the bottom of a cup-shaped electrode part which is placed coaxially in the second electrode, the bottom being substantially parallel to the bottom of the second electrode and being provided near or against the ends of the collars and comprising apertures for passing the electron beams.

BRIEF DESCRIPTION OF THE DRAWING

The invention will now be described in greater detail, by way of example with reference to a drawing, in which.

DESCRIPTION OF THE PREFERRED EMBODIMENTS

Figure 1:
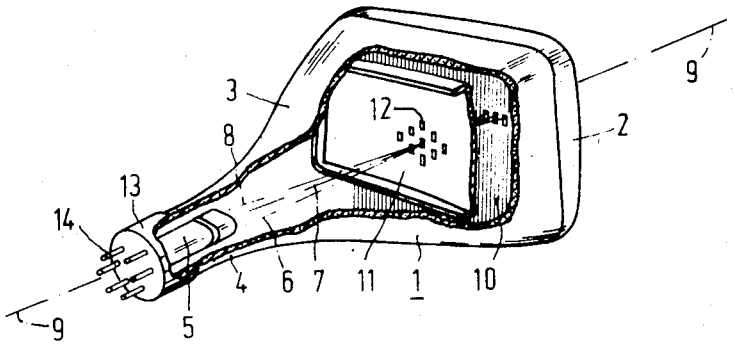
FIG. 1 is a perspective view of a cathode ray tube according to the invention.

FIG. 1 is a perspective view of an embodiment a cathode ray tube according to the invention comprising a colour display tube of the "in-line" type. An integrated electron gun system 5 which generates three electron beams 6, 7 and 8 which, prior to deflection, are situated with their axes in one plane, is provided in the neck 4 of a glass envelope 1 which is composed of a display window 2, a cone 3 and the neck 4. The axis of the central electron beam 7 coincides with the tube axis 9. The display window 2 has on its inside a large number of triplets of phosphor lines. Each triplet comprises a line consisting of a blue-luminescing phosphor, a line consisting of a green-luminescing phosphor and a line consisting of a red-luminescing phosphor. All triplets together constitute the display screen 10. The phosphor lines are substantially perpendicular to the plane through the two axes. The shadow mask 11, which has a multiplicity of elongate apertures 12 through before the electron beams 6, 7 and 8 pass which impinging on phosphor lines of respective colours is positioned in front of the display screen. The three electron beams which are situated in one plane are deflected by a system of deflection coils, not shown. The tube also has a tube base 13 having connection pins 14.

Figure 2:
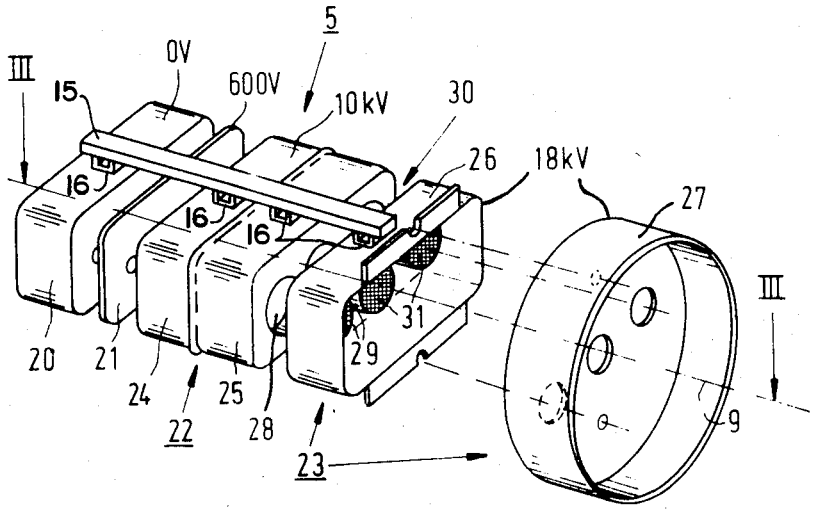
FIG. 2 shows an electron gun system for such a tube.

FIG. 2 is a perspective view, partly exploded, of an electron gun system of the type used in the colour display tube of FIG. 1. The electron gun system 5 comprises a common cup-shaped control electrode 20 in which three cathodes (not visible) are disposed and a common plate-shaped anode 21. Cathodes, control electrode and anode together constitute the triode part of the electron gun system. The three electron beams situated with their axes in one plane are focused by means of the first lens electrode 22 and the second lens electrode 23 which are common to the three electron beams. Electron 22 consists of two cup-shaped lens electrode parts 24 and 25 which are connected together at their open ends. The second lens electrode 23 comprises a cup-shaped lens electrode part 26 and a centring sleeve 27 which is used to centre the electron gun system in the tube neck. The oppositely located parts of the lens electrodes 22 and 23 include apertures 28 from which collars 29 extend in the electrodes and on which flat gauzes 31 are connected in electrode part 26 at a distance from the lens gap 30. As will be explained hereinafter, the spherical aberration in the electron beams can be drastically reduced by providing the flat gauzes at a distance from the lens gap. The voltages at the electrodes are shown in the figure.

Figure 3:
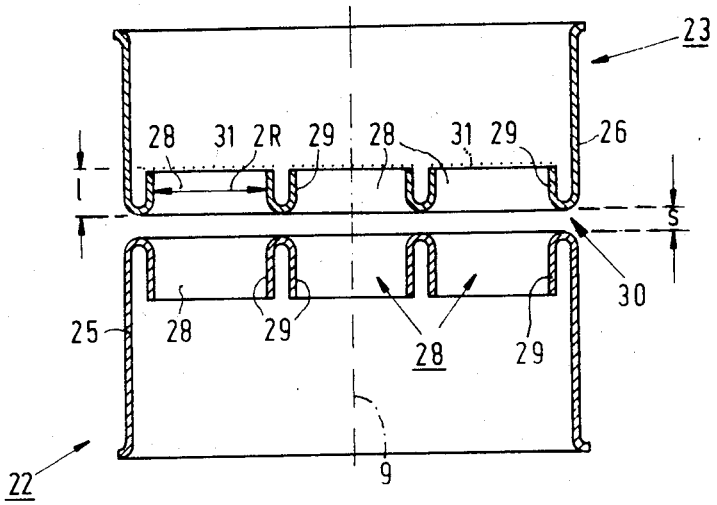
FIG. 3 is a longitudinal sectional view of a part of the electron gun system shown in FIG. 2.

FIG. 3 is a longitudinal sectional view of a part of the electron gun system shown in FIG. 2. The lens gap 30, for example, has a length S of 1 mm measured in the direction of the axis 9. The collars 29 in part 25 of the electrode 22 have a diameter of 5.4 mm and a length of 2.5 mm. The axes of the cylindrical collars are situated beside each other in one plane at distances of 6.5 mm. The collars 29 in part 26 of electrode 23 have a diameter of 5.78 mm and a length of 1.7 mm. The axes, of the collars are situated in one plane at distances of 6.69 mm from each other. The length of the collars is variable. A difference in collar height may also be produced between the collars around the central beam and the collars around the side beams. The apertures of the gauge are provided at a pitch of 30 μm. The bars of the gauze are 10 μm wide.

Figure 4:
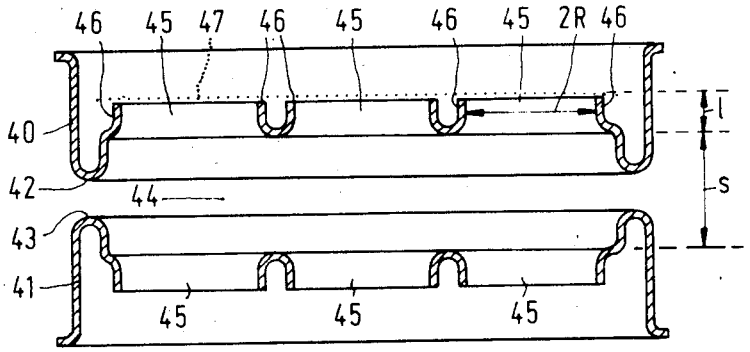
FIG. 4 shows a part of another embodiment of an electron gun system for a tube according to the invention.

FIG. 4 shows a part of another embodiment of an electron gun system for a tube according to the invention. An electron gun system having such an accelerating lens is described, for example, in U.S. Pat. No. 4,370,592 which may be considered to be incorporated herein by reference. The electrode parts 40 and 41 are provided with facing upright folded collars 42 and 43 respectively. The lens gap 44 has a length S of 457 mm. The gap length is measured between the parts of the electrodes in which the apertures 45 are provided. From the apertures 45 in electrode part 40 collars 46 having a length of 1.0 mm extend from the lens gap 44 across which a gauze 47 has been provided which is common to all collars. The apertures 45 and the associated collars in the electrode parts 40 and 41 are not necessarily circular, but may be elliptical, elongate or pear-shaped, the latter shape being shown, for example, in Netherlands Patent Application 8302737 (corresponding to U.S. patent application Ser. No. 635,776 filed July 30, 1984) which has not yet been laid open to public inspection and which may be considered to be incorporated herein by reference. In that case, the average radius of the aperture is taken as the radius R.

Figure 5A:
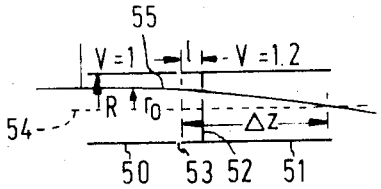
FIG. 5*a* shows diagrammatically an accelerating electron lens.

FIG. 5*a* shows diagrammatically an accelerating electron lens having two cylindrical electrodes 50 and 51 each having a radius R. Electrode 51 has a flat foil 52 situated at a distance l from the lens gap 53. The width of the lens gap 53 is 0.1 R. The potentials of the electrodes are indicated in the figure. $r_o$ is the distance of any ray 55 of an electron beam parallel to the tube axis 54 which intersects the tube axis at a distance Δz from the lens gap.

Figure 5B:
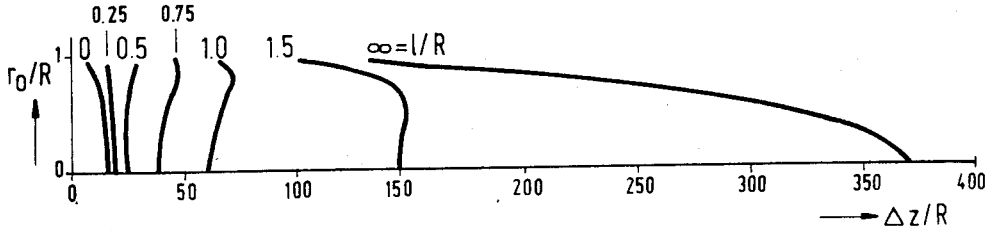
FIG. 5*b* shows, for a few values of l/R, z/R as a function of $r_o/R$.

In FIG. 5*b* the values Δz/R are indicated as a function of $r_o/R$ for the values l/R=0, 0.25, 0.5, 0.75, 1.0, 1.5 and infinity (∞). This figure shows clearly that:

(a) the lens strength increases considerably by the addition of the foil, for Δz/R becomes much smaller for values other than $l/R=C\infty$. ($l/R=\infty$ in fact corresponds to no foil), (b) the spherical aberration is negative for all rays if $0.5<l/R<1.0$, (c) the spherical aberration is negative for rays for which it holds that $r_o/R=0.7$ for $l/R=1.5$ and becomes positive for $r_o/R>0.7$, (d) for a lens without the foil the spherical aberration is purely positive, (e) the spherical aberration is also positive for $l/R<0.25$.

It has clearly been demonstrated that the positive foil lens or gauze lens can be made with negative spherical aberration if over a large part of the lens diameter $l/R<2.0$.

The spherical aberration behaviour also depends on the ratio $V_2/V_1$, where $V_1$ and $V_2$ are the potentials at the first and the second lens electrodes, respectively, as will be described with reference to FIGS. 6 and 7.

Figure 6:
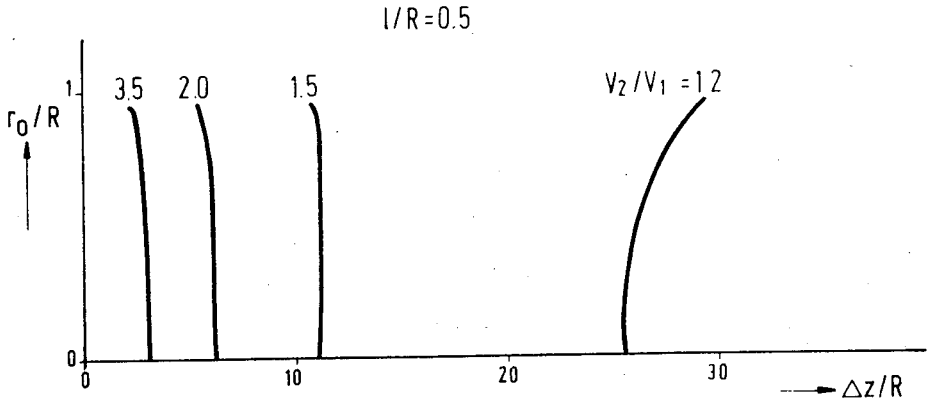
FIG. 6 shows for a number of values of $V_2/V_1$, z/R as a function of $r_o/R$ for $l/R=0.5$.
Figure 7:
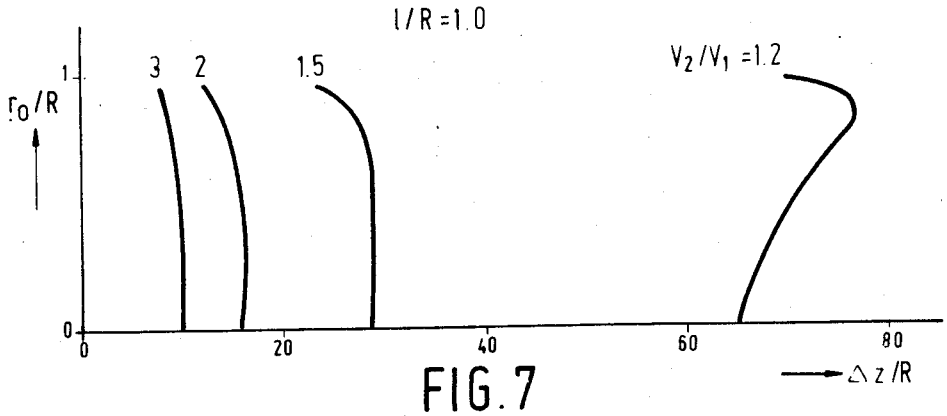
FIG. 7 shows the same for $l/R=1.0$.

What happens for $V_2/V_1$ value larger than the value in FIGS. 5*a, b* is shown in FIGS. 6 and 7, where Δz/R is again shown as a function of $r_o/R$ for l/R=0.5 and 1.0, respectively. FIGS. 6 and 7 show that the spherical aberration depends on the ratio $V_2/V_1$. An increasing ratio $V_2/V_1$ adds a positive contribution to the spherical aberration present.

It follows from FIGS. 5*b*, 6 and 7 that for $0.25<l/R<2.0$, with a simple flat foil or gauze, the spherical aberration can be considerably reduced and can be reduced to acceptable proportions by a correct choice of the beam diameter with respect to the lens, the voltage ratio $V_2/V_1$ and the value of l/R.

Figure 8:
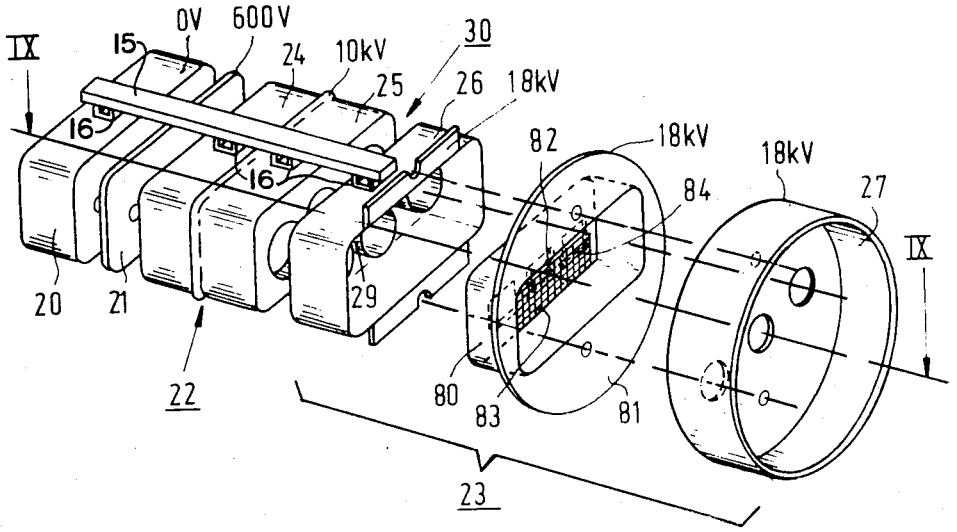
FIG. 8 is a perspective view of another embodiment of an electron gun system for a tube according to the invention.

FIG. 8 is a perspective view of another embodiment of an electron gun system for a tube according to the invention. This system is substantially identical to the FIG. 2 system and the same reference numerals are used for the same components. A lens component 80 is connected in lens component 26 and between the lens components 26 and 27. Lens component 80 is cup-shaped and has a connection flange 81. The apertures 82 in the bottom 83 of the cup-shaped lens component 80 are situated substantially coaxially with the collars 29 extending in lens component 26. A gauze 84 which is common to all apertures 82 is provided on the inside of bottom 83 which is substantially parallel to the bottom of lens component 26. Of course it is also possible to connect the gauze on the side of the bottom 83 of the cup-shaped lens component 80 facing the collar 29.

Figure 9:
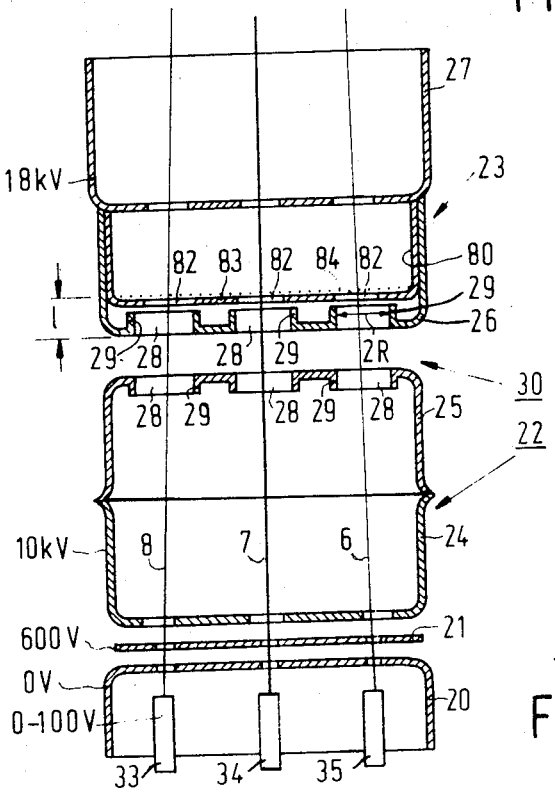
FIG. 9 is a longitudinal sectional view of the electron gun system shown in FIG. 8.

FIG. 9 is a longitudinal sectional view of the electron gun system shown in FIG. 8. Three cathodes 33, 34 and 35 for generating three electron beams 6, 7 and 8 are present in the control electrode 20. It is not necessary for the collars 29 to extend against the bottom 83 of the lens component 80. In this type of gun, however, there must always be allowance for the location of the gauze at the distance l from the lens gap and the radius R of the collars 29.

The invention is not restricted to the multibeam colour display tubes described but may also be used in tubes having only one electron beam, for example, projection television display tubes, monochromatic DGD tubes or camera tubes in which an accelerating focusing lens is used.

Figure 10:
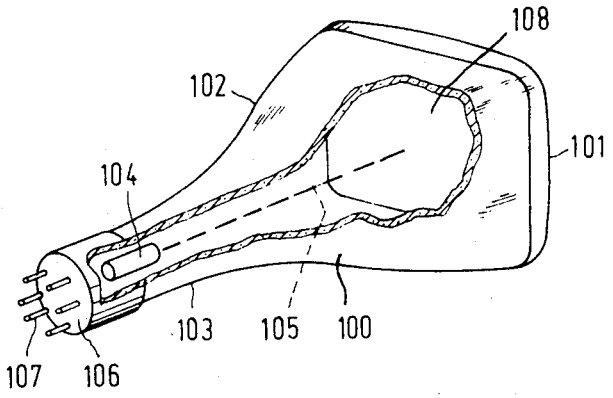
FIG. 10 is a perspective view of a projection display tube according to the invention.

FIG. 10 is a perspective view of a projection television display tube according to the invention. An electron gun 104 which generates only one electron beam 105 is provided in the neck of a glass envelope 100 which is composed of a display window 101, a cone 102 and a neck 103. The beam is deflected over the display screen 108 by means of a system of deflection coils, not shown, which screen is provided on the inside of the display window 101. By providing, in the manner shown in FIG. 5*a*, a flat foil in the focusing lens of the electron gun 104 the spherical aberration in the electron beam is drastically reduced. The tube comprises a tube base 106 having connection pins 107.

Figure 11:
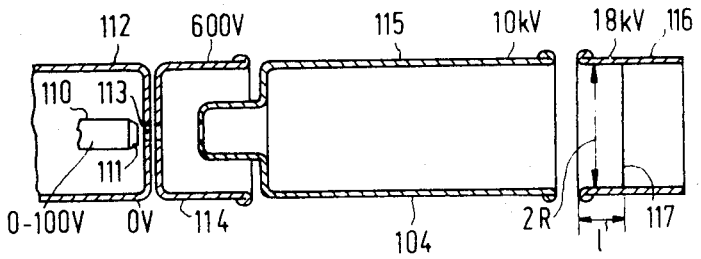
FIG. 11 is a longitudinal sectional view of an electron gun for the projection television display tube shown in FIG. 10.

FIG. 11 is a longitudinal sectional view of the gun 104 for a projection television display tube shown in FIG. 10. This gun comprises a cathode 110 having an emissive surface 111. The cathode is situated in the control electrode 112 with its emissive surface opposite to the aperture 113. Opposite the control electrode 112 is situated the anode 114 which is followed by an accelerating focusing lens consisting of the electrodes 115 and 116. A 200 Å thick foil of berrylium is provided electrode 116. The radius R of electrode 116 is 5 mm. The distance l between the foil 117 and the lens gap is 2.5 mm. The voltages at the electrodes are indicated in the figure.

In FIGS. 2 and 8 the electrodes of the electron gun system are connected together in the conventional manner by means of glass rods 15 and braces 16.

What is claimed is:

1. In a cathode ray tube comprising an evacuated envelope containing a target and an electron gun system including at least one electron gun for producing a respective electron beam directed along a longitudinal axis of the gun and for focussing said electron beam onto said target, said electron gun including, in the direction of propagation of the electron beam, first and second electrodes having facing end portions with respective first and second openings disposed coaxially around said axis, said end portions being separated by a predetermined gap and, when predetermined voltages are applied to said electrodes, effecting production of an accelerating electron lens;

the improvement comprising means for effecting a predefined correction of spherical aberration of the lens, said means comprising a substantially flat, conductive, electron-penetrable member electrically connected to the second electrode and extending across the second opening, said member being located at a distance l from the closest end of the gap, said distance falling within the range $0.25 < l/R < 2.0$, where R is the radius of the second opening.

2. A cathode ray tube as in claim 1 wherein said tube is a projection television display tube.

3. A cathode ray tube as in claim 1 where said tube is a data graphic display tube.

4. A cathode ray tube as in claim 1 where the second electrode is cup-shaped, has the second opening formed in a bottom thereof, and includes a collar surrounding said second opening and extending away from the gap, the electron-penetrable member being provided adjacent an end of said collar remote from said gap.

5. A cathode ray tube as in claim 4 and further including a second cup-shaped electrode disposed within the second electrode, said second cup-shaped electrode having an opening in a bottom thereof located adjacent the collar surrounding the second opening, said electron-penetrable member being disposed against the bottom of the second cup-shaped electrode.

6. A cathode ray tube as in claim 1, 4 or 5 where the tube comprises a color display tube and where the electron gun system comprises a plurality of electron guns for producing respective electron beams along axes lying in a single plane, said first and second electrodes each including a plurality of said first and second openings, respectively, disposed coaxially around the respective ones of said axes.

7. A cathode ray tube as in claims 1, 2, 3, 4 or 5 where the electron-penetrable member comprises a foil.

8. A cathode ray tube as in claims 1, 2, 3, 4 or 5 where the electron-penetrable member comprises a gauze.

* * * * *